United States Patent [19]

Matkin et al.

[11] Patent Number: 4,636,451

[45] Date of Patent: Jan. 13, 1987

[54] PRESSURE-FIXABLE TONER MATERIAL AND METHOD OF MAKING SAME

[75] Inventors: Josef Matkin, Malvern; Richard J. Treleaven, Toorak Gardens, both of Australia

[73] Assignee: Minnesota Mining and Manufacturing Company, St. Paul, Minn.

[21] Appl. No.: 829,011

[22] Filed: Feb. 13, 1986

[51] Int. Cl.[4] ..... G03G 9/08

[52] U.S. Cl. ..... 430/109; 430/137; 430/138; 430/98; 430/903; 428/407

[58] Field of Search ..... 430/109, 137, 138, 903; 428/407

[56] References Cited

U.S. PATENT DOCUMENTS

| | | | |
|---|---|---|---|
| 3,383,316 | 5/1968 | Matkan | 430/109 |
| 3,720,534 | 3/1973 | Macaulay et al. | 430/109 |
| 3,804,764 | 4/1974 | Strella et al. | 430/109 |
| 3,925,219 | 12/1975 | Strong | 430/109 |
| 4,206,064 | 6/1980 | Kiuchi et al. | 430/106 |
| 4,254,201 | 3/1981 | Sawai et al. | 430/111 |
| 4,307,169 | 12/1981 | Matkan | 430/111 |
| 4,311,779 | 1/1982 | Miyakawa et al. | 430/107 |
| 4,362,803 | 12/1982 | Miyakawa et al. | 430/122 |
| 4,379,825 | 4/1983 | Mitushashi | 430/111 |
| 4,415,645 | 11/1983 | Kouchi et al. | 430/107 |
| 4,439,510 | 3/1984 | McLoughlin | 430/137 |
| 4,442,194 | 4/1984 | Mikami | 430/137 |
| 4,447,516 | 5/1984 | Matkan | 430/109 |
| 4,450,221 | 5/1984 | Terada et al. | 430/106.6 |
| 4,455,362 | 6/1984 | Naoi et al. | 430/137 |
| 4,465,755 | 8/1984 | Kiritani et al. | 430/111 |
| 4,465,756 | 8/1984 | Mikami et al. | 430/138 |
| 4,468,446 | 8/1984 | Mikami et al. | 430/138 |
| 4,476,211 | 10/1984 | Hosoi | 430/137 |
| 4,476,212 | 10/1984 | Kakimi | 430/137 |

FOREIGN PATENT DOCUMENTS

| | | |
|---|---|---|
| 0002119 | 5/1979 | European Pat. Off. . |
| 0088566 | 9/1983 | European Pat. Off. . |
| 0103967 | 3/1984 | European Pat. Off. . |

*Primary Examiner*—John D. Welsh

*Attorney, Agent, or Firm*—Donald M. Sell; James A. Smith; David L. Weinstein

[57] ABSTRACT

Pressure-fixable toner particles suitable for use in electrostatic copying machines and method of preparing same. The toner particle is spherical in shape and comprises a thin, substantially continuous surface layer of polyurea, and an interior portion comprising a matrix of polyurea, said matrix having a colorant and pressure-fixable material contained therein, said polyurea matrix forming a continium extending from the surface layer inwardly toward the center of said particle. The method comprises:

(1) admixing colorant, pressure-fixable material, isocyanate, and matrix-forming co-reactant to form a mixture, (2) emulsifying said mixture in an aqueous medium containing a non-reactive emulsifying agent to provide a dispersion of spheres of the mixture, (3) hydrolyzing a first portion of the isocyanate near the surface of the spheres to initiate formation of polyurea at the surface of the spheres as a thin, substantially continuous layer and in the interior of the spheres as a continuum for some distance beneath the surfaces of said spheres, and reacting a second portion of the isocyanate with said matrix-forming co-reactant to form additional matrix material in the interiors of the spheres, (4) removing the emulsifying agent from the dispersion, and (5) removing water from the dispersion to obtain dry spherical toner particles.

19 Claims, 2 Drawing Figures

PRESSURE-FIXABLE TONER MATERIAL AND METHOD OF MAKING SAME

BACKGROUND OF THE INVENTION

This invention relates to electrostatography, and, more particularly, it relates to novel pressure-fixable type electroscopic marking particles, or, as commonly called, pressure-fixable toner material, and to the method of preparing same.

In electrostatography it is well known to tone electrostatic latent images contained on the surface of a recording member, such as a photoconductor or dielectric material, with dry toners which form pressure-fixable image deposits. Such image or toner deposits are, in certain instances, pressure fixed directly onto the recording member whereas in other instances the toner deposits are formed on the surface of a reusable photoconductor, such as, for instance, selenium, and transferred therefrom, usually by electrostatic methods, onto a receptor such as paper and affixed thereto by pressure. The pressure-fixing process involves normally passing the receptor such as the paper sheet containing the unfixed toner deposits thereon through the nip of a pair of rotating pressure rollers.

Prior art pressure-fixable toners are of the so-called two components or single component type. Two component toners are admixed with a carrier powder to form a developer mixture which is applied to the latent image-bearing recording member surface, as by a magnetic brush or by cascading, as is well known in the art; the toner is usually treated with a polarity control or charge control or tribocharging agent so that by admixture with the appropriate carrier powder and consequent tribocharging, the desired polarity will be conferred onto the toner, for instance, negative polarity if it is desired to develop a latent image formed by positive charges on a recording member, such as a selenium photoconductor.

Single component pressure-fixing toners usually contain a magnetic pigment such as magnetite or ferrite. The applicator for single component toners normally comprises a rotating multiple magnet roll contained within a stationary or rotating non-magnetic sleeve to the surface of which the toner is attracted, forming a magnetic brush thereon; such magnetic brush is contacted with the surface of the latent image-bearing recording member and development occurs by toner attraction to the charge-holding latent image areas. Here again it is necessary that the toner be of the correct polarity or be correctly tribocharged in relation to the polarity of the latent images on the recording member, for instance, to be of negative polarity, if it is desired to develop a latent image formed by positive charges on a recording member, such as a selenium photoconductor. Although correct polarity or charging or tribocharging of single component toners can be attained by such means as applying a bias voltage between the magnet roll applicator or other parts of the toning assembly and the conductive backing of the recording member or selecting of metals or materials for parts in contact with the toner in the toning assembly so as to be appropriately located in the tribo series, usually the single component toners are treated with polarity or charge controlling or tribocharging agents to confer the desired polarity onto such toner material.

Prior art methods of preparing pressure-fixable two component and single component toners are disclosed, for instance, in U.S. Pat. Nos. 3,804,764 of Strella et al. and 3,925,219 of Strong, respectively.

A typical prior art method of preparing two component toners incorporating a charge or polarity controlling agent is disclosed in U.S. Pat. No. 4,206,064 of Kiuchi et al.

Typical methods of preparing prior art pressure-fixable single component toners with charge or polarity controlling agents are disclosed, for instance, in U.S. Pat. Nos. 4,311,779 and 4,362,803 of Miyakawa et al.

From the above references it will be seen that prior art pressure-fixable toners are prepared, in essence, by hot blending and kneading a pressure-fixable binder material such as polyethylene wax or a polymer, such as polystyrene and the like, with a colored or magnetic pigment and a charge control agent; upon cooling, the blend is crushed and pulverized, typically by jet milling, following which the powder is classified to the required toner particle size range, normally about 5 to 30 microns. It will also be seen that prior art charge or polarity control agents comprise, in general, oil soluble dyes, alcohol soluble dyes, dyes with metal complexes, and other compounds containing metals or metal complexes.

Prior art pressure-fixable toners have certain disadvantages. The polymers and waxes used in such toners as the pressure-fixable medium are characterized by having a hardness within a certain range and a softening point within a certain temperature range, hardness and softening point being in many materials closely related to each other. Materials of lesser hardness and softening point of lower temperature can be fixed at lower pressure. However, they present storage and handling problems in that toner particles comprising such materials, at slightly elevated temperatures, tend to adhere to each other and form agglomerates. This impairs the flow properties of the toner and results in uneven image formation on the recording member. Materials having a hardness and softening point above said range can be fixed at extremely high pressures only, which is unacceptable. Even those materials which are within said range, that is, where their hardness and softening point temperature are not likely to cause interparticulate adhesion and agglomeration, require high pressures to achieve an adequate degree of fixing. This results, first, in the need for very robust and consequently heavy and expensive pressure roller system; second, in limiting the speed at which paper receptor can be passed through the pressure rollers without creasing or mistracking due to the high pressure at which it is transported therethrough; and, third, in what is called calendaring the receptor paper, that is, imparting undesirable gloss to its surface. A further disadvantage of such prior art pressure-fixing toners is that they tend to contaminate the surface of reusable photoconductive or dielectric recording members by formation thereon of a thin polymer or wax film as such toner material is repeatedly applied to the recording member surface. This results in the need to clean the recording member surface at relatively frequent intervals, which is expensive and, in addition, shortens the useful life.

Another disadvantage of such prior art pressure-fixable toners relates to the types of charge or polarity control agents used therein and their method of incorporation. As disclosed in the above references, the charge or polarity control agents which confer negative polarity comprise oil soluble dyes, alcohol soluble metal containing dyes, compounds with metal complexes and the like. Such materials are dispersed in the wax or polymeric pressure-fixable binder during hot blending, and, consequently, they are distributed throughout the resulting toner particles rather than being only at the particle surface, which is the effective location for charge or polarity control. Those minute charge or polarity control particles which are at or on the toner particle surface are not firmly bonded thereto and can be dislodged during agitation in the toning unit or during repeated contact with the recording member surface, thereby causing contamination thereof, particularly since such charge or polarity control materials are chemically of non-inert nature.

The pressure required to fix the above-referred-to prior art toners is generally in the range of 200 to 300 pounds per lineal inch. Various methods have been recently proposed for the preparation of toners which can be fixed at lower pressures. An effective method which has been proposed consists in making toner particles which are porous or are in the form of aggregates, that is to say, toner particles containing discontinuities which upon application of relatively low pressure cause firstly disintegration of the particle and then fixing.

Toner particles containing discontinuities and fixable at low pressures in the range of about 76 to 150 pounds per lineal inch are disclosed in U.S. Pat. No. 4,254,201 of Sawai et al., incorporated herein by reference. In this case the toner particles are, in essence, porous aggregates where each aggregate consists of a multiplicity of granules comprising encapsulated pressure sensitive adhesive material. The encapsulating material causes formation of the aggregate by adhering granules to each other. The colored or magnetic pigment is contained within the aggregate in the interstices between the granules and on the surfaces of the encapsulated granules. Upon application of pressure, the porous aggregate disintegrates or deforms, and then the pressure sensitive adhesive material is released from the individual encapsulated granules to bond the virtually free pigment particles onto the receiving surface.

Toner particles containing discontinuities and fixable at even lower pressures, in the range of about 55 to 76 pounds per lineal inch, are disclosed in U.S. Pat. No. 4,379,825 of Mitushashi. In this case the toner is prepared by mixing, and then hot kneading, in essence, a pressure-fixable binder, a colored or magnetic pigment, and a so-called elimination compound which remains in solid form, as it does not melt at the temperature at which said binder softens or melts for hot kneading. Upon cooling, the mixture is crushed by a hammer mill and then pulverized in a jet mill. The powder is then immersed in a solvent which dissolves and removes the elimination compound, thus forming a porous particle structure. The porous particles are then washed, filtered, dried, and classified to the required size range. The pores or discontinuities in the particle render it brittle or fragile, and, therefore, it can be more readily crushed and pressure-fixed than particles having a solid or homogeneous structure.

The porous particles are of irregular shape and of irregular structure in both surface and interior. The patent states, in column 2, lines 11–14, that true spherical shape particles are unsuitable for pressure-fixing.

While the above referred to toner particles containing discontinuities can be fixed at low pressures, they have certain disadvantages. The porous aggregate particles of U.S. Pat. No. 4,254,201 of Sawai et al. contain, of necessity, free colored or magnetic pigment on their surfaces, which makes these toner particles prone to cause contamination of the recording member, toning unit, and copier interior. The porous particles of U.S. Pat. No. 4,379,825 of Mitushashi are produced by a complicated process involving many steps, and, in addition, the process is wasteful because of the need to dissolve and then discard the elimination compound and the solvent therefor. Furthermore, Mitushashi states that the magnetite content of his toners may vary between 15 and 70 percent by weight, his preferred proportion being 20 to 50 percent by weight. His examples contain between 26 and 46.5 percent magnetite. Most commercial toners contain between about 55 to 65 percent by weight magnetite, and toners containing more than 55 percent by weight magnetite, made in accordance with these teachings, are extremely friable and tend to break up on the toning unit, giving rise to the production of foggy and low density copy, as well as dusting. In addition, both above-referred-to types of toner particles have the common disadvantage in that the charge or polarity control agents have to be included within the body of the toner material in the same manner as in prior art pressure-fixing toners as described previously.

SUMMARY OF THE INVENTION

The principal object of the present invention is to overcome the disadvantages of the low pressure-fixable toners of the type wherein the particles contain discontinuities and wherein the charge or polarity control agent is included within the body of the toner material.

In accordance with the present invention, there is provided a novel and simple method of preparing pressure-fixable toner material wherein the toner particles contain discontinuities formed by a polyurea matrix which facilitates particle disintegration upon application of pressure and thus allows low pressure fixability. Polarity control is effected by the polyurea surface, which is a continuum of said matrix. The polyurea is an integral part of the particle surface so that constant polarity characteristics of the particles are maintained and contamination of the recording member is eliminated.

DESCRIPTION OF THE INVENTION

Figure 1:
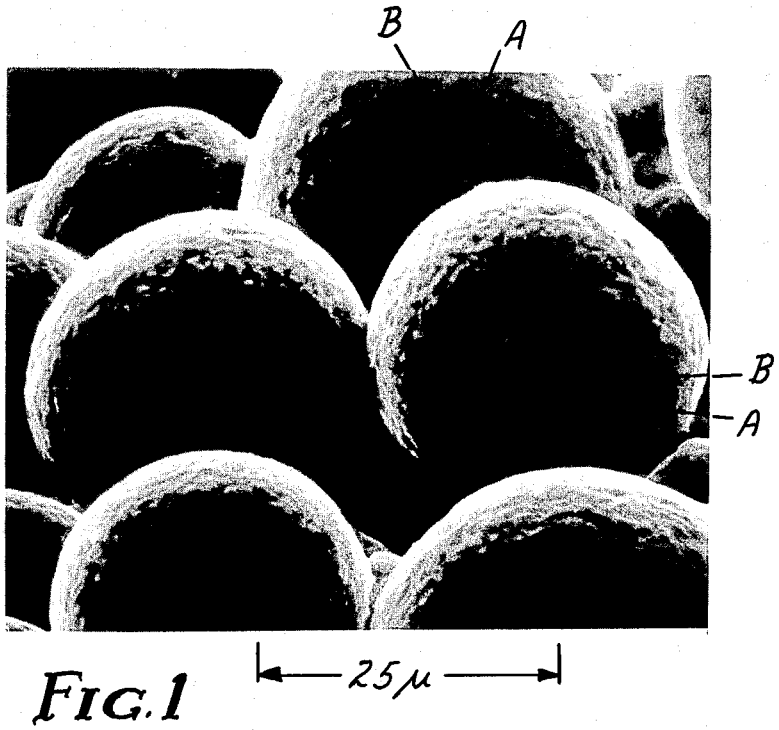
FIG. 1 is a picture of toner particles photographed at 2000× using a scanning electron microscope.

The polarity control substance of the present invention is polyurea which has been found to be very effective for conferring negative polarity or polarity onto toner particles.

In U.S. Pat. No. 3,383,316, incorporated herein by reference, there is disclosed that isocyanates and polyisocyanates containing the isocyanate group $-N=C=O$ act as negative polarity or charge control agents when adsorbed onto toner particles; however, in that patent it is also disclosed that the principle governing this effect is not fully understood.

In all Examples of that patent, in addition to the isocyanate or polyisocyanate, there had been included at least one other compound, such as a vegetable oil or hydrogenated rosin or ester gum or a rosin ester dispersed pigment called Microlith, which was capable of reacting with isocyanate to form polyurea and specifically acyl urea in certain instances. Indeed, IR spectrophotometry revealed the presence of polyurea in all toners prepared in accordance with those Examples. I have now established that polyurea by its very nature is an efficient negative polarity control agent. However, the mechanism of its agency is still not fully understood.

I have now discovered a novel method of producing toner particles wherein the negative polarity control properties of polyurea are utilized at the surface of such particles by forming an integral part thereof rather than being more or less loosely adsorbed thereto, and furthermore wherein polyurea is also utilized to create discontinuities throughout the particles by being present therein in the form of a matrix. As used herein, the term "discontinuities" refers to heterogeneities among the various materials included in the interior portion of the spheres of this invention; that is, the term refers to the differing chemical identities among the various materials in the interior portion of the spheres, such as the colorant (e.g. magnetite) or pressure-fixable material (e.g. wax) differing from the matrix material (e.g. polyurea); the term "discontinuities" is not intended to imply the presence of voids. The term "continuum" refers to a structure in which at least a portion of the polyurea material in the interior portion of the sphere is chemically integral with the thin polyurea surface layer of the sphere. The terms "sphere", "spherical" when used to refer to particles are also intended to include spheroids and spheroidal particles. The polyurea forming part of the toner particles at the surface thereof, being a continuum of said matrix, provides constant polarity control and prevents recording member contamination as well as particle agglomeration, while the polyurea matrix, which creates discontinuities within the particles, facilitates disintegration thereof upon application of pressure, hence providing low pressure fixability.

Unlike the prior art toners referred to previously, the toner particles of the present invention are spheres composed of substantially solid pressure-fixable material having discontinuities therein formed by a polyurea matrix, said spheres containing a very thin polyurea layer at their surface, hereafter referred to as the polarity control layer, which layer is diffused or extends into the sphere material for some distance beneath the surface thereof and is a continuum of said matrix. The toner particles of this invention are produced by a method comprising:

(1) admixing a colorant and a pressure-fixable material with an isocyanate and a matrix-forming co-reactant to form a mixture, (2) emulsifying said mixture to form a dispersion of spheres of said mixture in an aqueous solution containing a nonreactive emulsifying agent, (3) hydrolyzing part of the isocyanate near the surface of said spheres by contact with water in the aqueous solution to initiate formation of polyurea which is at high concentration at the surfaces of said spheres as a very thin, yet substantially continuous layer and in the interiors of said spheres as a continuum for some distance beneath the surfaces thereof, said continuum being a polyurea matrix, and reacting the remainder of isocyanate with said matrix-forming co-reactant to form additional matrix material in the interiors of said spheres, (4) removing said emulsifying agent from the dispersion, e.g. by washing, and (5) then removing the water from the dispersion to obtain dry toner particles.

In more detail, a mixture is prepared comprising, in essence, colorant, such as one or more pigments or dyes, pressure-fixable material, a matrix-forming co-reactant, and an isocyanate. Such a mixture can be prepared by hot blending the pressure-fixable material with the colorant and matrix-forming co-reactant, followed by milling or other methods to obtain a dispersion of the colorant. Alternatively, the colorant can be predispersed with the matrix-forming co-reactant and such pre-dispersion then hot blended with the pressure-fixable material and further dispersed therein. The isocyanate is then added to such dispersion and homogenized therewith to form a mixture which is to be emulsified.

A simple method which has been found to be effective, particularly with magnetic pigments, is to first heat the pressure-fixable material to a temperature above its melting point, blend in the matrix-forming co-reactant and a non-reactive plasticizer, if used, at the same temperature, and then stir in the pigment, while maintaining the temperature of the mixture above the melting point of the pressure-fixable material. The mixture is then milled in a high shear mixer, such as a Cowles dissolver or the like, for 2 to 3 hours to disperse the pigment, during which period the temperature of the mixture is normally maintained substantially above the melting point of the pressure-fixable material, such as, for example, 30° C. to 100° above such melting point. The milled mixture is allowed to cool to a temperature typically of about 70° C. before addition of the isocyanate to avoid premature reaction between the matrix-forming co-reactant and the isocyanate, which reaction has been observed to occur typically at a temperature in excess of about 80° C., but these temperatures depend, of course, on the type of isocyanate and/or matrix-forming co-reactant used.

An alternative method which has been used successfully for the preparation of mixtures containing magnetic pigments, but which is particularly suitable for the incorporation of non-magnetic pigments, consists of mixing the pigment with the matrix-forming co-reactant and dispersing such pigment therein on a high shear mill, such as a triple roll mill or the like, preferably cooled to keep the temperature of the dispersion below that at which premature oxidation or polymerization of the matrix-forming co-reactant would occur. The pressure-fixable material is then added to the dispersion in molten state, together with the plasticizer, if used, and the mixture is homogenized in a high speed stirrer or Cowles dissolver or the like.

It should be pointed out here that the matrix-forming co-reactant is added to the above mixture to reduce the viscosity thereof only to a degree where it can be emulsified but not to a degree where such mixture becomes a semi-fluid, that is to say, where the viscosity of such mixture becomes low enough to allow mobility of the isocyanate within the microspheres and thus migration of isocyanate to the surface of such spheres.

Such mixture is then emulsified at appropriate temperature to form a dispersion of microspheres in an aqueous solution of an emulsifying agent which is non-reactive with isocyanate.

Emulsification is carried out in an aqueous solution of an emulsifying agent. In order to maintain the constant negative polarity control properties of the polyurea layer on the final toner particles in accordance with the present invention, it is essential that such polyurea layer not contain thereon or have attached thereto any other substance, such as a reaction product between the isocyanate and the emulsifying agent or a residue of the emulsifying agent, which may impair or affect the natural control properties of polyurea.

Thus, the emulsifying agent is selected to be non-reactive with isocyanates, to have no effect on the formation of the polyurea layer, and to have no tendency to strongly adsorb or adhere to polyurea, in order that it may be virtually completely removed therefrom by washing. Suitable emulsifying agents include sodium, potassium and ammonium lignin sulphonates, ethylene maleic anhydride, sodium dodecylbenzene sulphonate, sodium salt of styrene maleic anhydride, and the like. Emulsifying agents which are not suitable in accordance with the present invention include, for instance, polyvinyl alcohol, which interferes with the formation of the hydrolysis-initiated polyurea polarity control layer in that it itself reacts with isocyanate forming polyurethane, which results in the charge control layer being either a mixture of polyurea and polyurethane or being of polyurea covered with polyurethane. In addition, the unreacted polyvinyl alcohol adsorbs very strongly to the surface of the particles and cannot be readily removed therefrom by washing.

The emulsifying equipment can be of the batch type or the in-line or continuous type. Batch type equipment suitable for this purpose can be, for instance, the well-known Waring blender or such like equipment of the high shear type. The equipment, however, should be so chosen that the actual emulsion forming process, that is to say, the time during which high shear forces are applied, can be kept as short as possible, particularly when isocyanates which hydrolyze rapidly are used. Otherwise the polarity control layers which commence to form may break up.

Upon formation of the dispersion of microspheres in the aqueous solution of the emulsifying agent, that part of the isocyanate which is nearest the surface of the spheres is hydrolyzed by contact with water, whereby urea formation is initiated, such urea further reacting with the free isocyanate to form polyurea. While the concentration of such polyurea is highest at the sphere surface, where direct contact between isocyanate and water occurs, polyurea formation continues after initiation at the surface for some distance therebeneath into the sphere material. As the result of this, the polyurea at highest concentration present at the sphere surface forms a very thin yet substantially continuous layer and extends in a diffused or discontinuous form at decreasing concentration for some distance into the sphere. The remainder of the isocyanate, that is, non-reacted isocyanate just beneath the sphere surface, in the zone containing diffused polyurea and the isocyanate in the body of the sphere, reacts with the matrix-forming co-reactant, generally forming a matrix of a reaction product of the acylurea type as a continuum of said polyurea surface layer, to thereby substantially solidify the sphere material. The distance beneath the sphere surface to which the zone containing both diffused polyurea and acylurea type reaction products as a continuum extends, depends on specific factors as will be disclosed below.

Upon completion of reaction of part of isocyanate to form polyurea, and, optionally upon completion of the reaction between the remainder of isocyanate and the matrix-forming co-reactant, the emulsifying agent is removed from the dispersion by washing, following which the water is removed from the dispersion to obtain dry toner particles.

Preferably, the formation of polarity control layers and at least in part the matrix-forming reaction between the isocyanate and the matrix-forming co-reactant should occur after completion of the emulsifying process, within a period of about 4 hours, depending on the materials chosen, during which time the emulsion is kept agitated or stirred at slow speed. This results in a dispersion of polyurea polarity control layer and matrix-containing microspheres in the aqueous solution of the emulsifying agent.

The emulsifying agents are normally water soluble and, therefore, hydrophilic, and must be removed from the dispersion prior to separation of the spherical particles from the aqueous phase, because such hydrophilic materials on the surface of dry toner particles would absorb moisture from the ambient, and thereby render the toner humidity sensitive, and, in addition, the residue of such emulsifying agent on the particle surface would impair or affect the negative polarity control properties of polyurea. Such removal is preferably carried out by centrifugal separation, followed by washing with water, and further centrifugal separation if desired, or more simply by repeated decant washing. Such washing may be carried out at any stage after the formation of the polarity control layer and either before or after the matrix-forming reaction of the isocyanate with the matrix-forming co-reactant has been completed.

After removal of the emulsifying agent, the remaining water is removed to produce the pressure-fixable dry toner particles. A common method for such water removal is spray drying. Other methods can be employed such as filtration followed by air drying, vacuum evaporation, centrifugal separation followed by forced or natural evaporation, and the like.

The pressure-fixable material admixed with the pigment is normally a resin or polymeric material or a wax, preferably with a melting point within the range of 50° C. to 100° C. Examples of suitable materials are polystyrene, styrene butadiene copolymers, polyesters, acrylic and methacrylic polymers and copolymers, polyvinyl acetate, polyvinyl chloride, paraffin wax, certain polyethylene waxes, natural waxes such as beeswax, candellila wax, and the like.

The pressure-fixable material admixed with the pigment can be a bituminous material, that is, a material generally from the group comprising petroleum asphalts, coal tar pitch, gilsonite, natural asphaltum, trinidad pitch, and the like. Such bituminous material or bitumen for the purpose of this invention is selected to have a ball and ring softening point within the range 25° C. to 90° C., and may be used as the sole pressure-fixable material or in combination with other materials, such as those pressure-fixable materials previously mentioned.

The pigment is chosen to be of the color as desired, and may, for instance, be carbon black, phthalocyanine blue, lithol red, hansa yellow, magnetite or ferrite, as required for any particular application. For electrophotographic copying using so-called single component toning techniques, as is well known in the art, the preferred pigment is magnetite, with or without the addition of pigments or dyes of other colors. Any pigment grade magnetite can be used, preferably in conjunction with a suitable dispersing agent. Dye-stuffs such as nigrosine, sudan black, and colored dyes may also be included for hue modification. Specific magnetic pigments which may be used, either alone or in combination with colored pigments or dyes, are ferrites of zinc, cadmium, and manganese, iron, cobalt or nickel powders, and chromium oxides. Of particular interest are hydrated ferric oxides which are yellow in color, zinc ferrites which are light tan in color, and ferric oxides which are red in color.

The matrix-forming co-reactant is generally a dual function material in that in addition to reacting with isocyanate to form a solid or semisolid reaction product, it also serves as the dispersing agent for the pigment. Preferred materials with suitable dispersing properties are dying and semi-drying vegetable oils such a linseed oil, tung oil, oiticica oil, safflower oil, sunflower seed oil and the like, synthetic drying oils such as dehydrated castor oil and modified marine oil fractions, and the like. Other dispersing agents may be included if desired to suit particular pigments. In addition, reaction or polymerization promoting additives such as metallic driers or catalysts may be included to assist or control the rate of hardening of the matrix-forming co-reactant.

In addition to the matrix-forming co-reactant, other materials may be added in small quantities to confer some plasticity to the substantially solid sphere material. Such materials are generally chosen to be non-reactive with the isocyanate or the matrix-forming co-reactant and may include non-drying vegetable oils such as castor oil, mineral oils and plasticizers such as dibutyl phthalate, and the like. Such materials are normally added in relatively small quantities, such as up to 10 percent by weight, preferably up to 5 percent by weight.

The preferred isocyanates are tolylene diisocyanate, 4,4'-diphenylmethane diisocyanate, and polymethylene polyphenylisocyanate, but any aromatic or aliphatic polyfunctional isocyanates such as diisocyanates, triisocyanates, tetraisocyanates and isocyanate prepolymers can be used if desired. Catalysts, such as tertiary amines, organometallic compounds, tertiary phosphine, alkali metal compounds and radical forming agents may also be included if desired.

The thickness of the polarity control layer and the strength of the matrix-forming discontinuities whereby the final hardness of the particle is determined, that is to say, its capability to disintegrate upon application of pressure, are governed largely by the type and quantity of isocyanate, type and quantity of matrix-forming co-reactant, and quantity of plasticizer, if used. It will be realized that isocyanates such as tolylene diisocyanate and 4,4,'-diphenylmethane diisocyanate hydrolyze somewhat more rapidly in the presence of water than, for example, polymethylene polyphenylisocyanate. Thus, it could be expected that the first two of these materials will hydrolyze very quickly on contact with water to initiate the polyurea forming reaction to produce the polarity control layer. With polymethylene polyphenylisocyanate hydrolysis will occur at somewhat slower rate. It can also be expected that proportionally more of the fast hydrolyzing isocyanate will react to form the polarity control layer than will be the case with slower hydrolyzing isocyanates. Using a matrix-forming co-reactant of the drying oil type, such as linseed oil, which is susceptible to oxidation polymerization as well as reacting with isocyanate, it is possible to form a very strong matrix which produces toner particles which are completely solid when finally dried. However, with a semidrying oil such as safflower oil or sunflower seed oil, oxidation polymerization may be retarded to the extent that the other particles retain some degree of softness or plasticity and disintegrate more readily upon application of pressure. Thus the reactive components can be balanced in proportion and chosen in type to produce within limits whatever polarity control layer thickness is desired. Spherical toner particles encased by the polarity control layer may exhibit varying degrees of plasticity, varying strength of the matrix forming a continuum with said polarity control layer, and varying capability to disintegrate upon application of pressure. The degree of plasticity of the particles may be further modified by the inclusion of small quantities of the non-reactive plasticizer previously disclosed.

It will be realized from the foregoing that the type and quantity of matrix-forming co-reactant and the type and quantity of isocyanate included therewith prior to emulsification will have a significant influence on matrix formation. The relatively slow polyurea formation by hydrolysis-initiated polymerization of isocyanate allows time for reaction of part of the isocyanate with the matrix-forming co-reactant. In contrast, the use of a second reactant such as an amine in the aqueous phase would accelerate considerably the formation of the polyurea surface layer at the time at which the matrix-forming co-reactant is still relatively fluid, which would cause isocyanate migration towards the outer surface, resulting in isocyanate depletion within the particles, such depletion in the limiting case precluding matrix formation with the matrix-forming co-reactant. The use of such second reactant is therefore not desirable in accordance with this invention.

Further, the quantity of matrix-forming co-reactant added for matrix formation should be such that the matrix formed tends to be rupturable to faciliatate pressure fixing of the toner upon particle disintegration. I have found that such a matrix can be formed when the matrix-forming co-reactant comprises about 5 percent to about 20 percent of the mixture, excluding the isocyanate, preferably 6 percent to 10 percent. If the matrix-forming co-reactant content is below about 5 percent, matrix formation generally does not occur, whereas if the matrix-forming co-reactant content is greater than about 20 percent, excessive hardening of the particles occurs on aging, impairing pressure fixability of the particles.

The pigment, pressure-fixable material, matrix-forming co-reactant, isocyanate, and optional additives, including non-reactive plasticizers in small quantities previously referred to, are normally compounded in such proportions that they form a mixture with a viscosity generally within the range 500 to 50,000 centipoise, preferably 1000 to 10,000 centipoise, at a temperature of 60° C., the viscosity being selected primarily to allow the chosen emulsification method and emulsifying agent to produce spherical particles in suspension in the desired particle size range, which for the purpose of this invention is 5 to 40 microns, preferably 10 to 25 microns.

Figure 2:
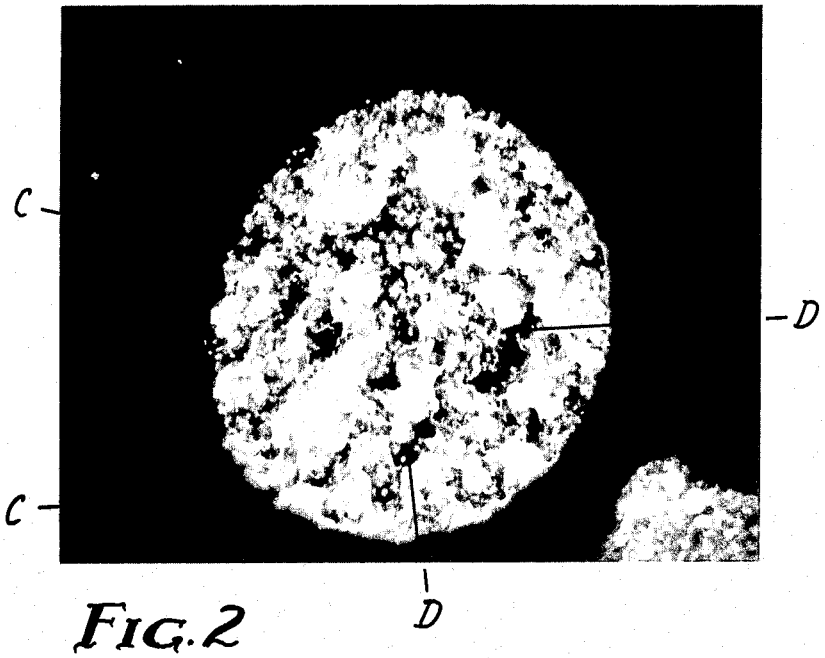
FIG. 2 is a picture of a cross-section of the toner particles of FIG. 1 photographed at 2000× using a scanning electron microscope.

Typical dried toner particles produced in accordance with the foregoing disclosure of this invention are shown in the illustrations which comprise scanning electron microphotographs where FIG. 1 represents a group of spherical toner particles and FIG. 2 represents a cross-section of one spherical toner particle.

Referring now to FIG. 1 in more detail, it will be noted that the toner particles are virtually perfect spheres having their surfaces formed by a very thin and substantially continuous layer, which is the polyurea polarity control layer as hereinbefore described. In this case such layer is so thin that in certain places, for instance, where indicated by the letter A, the layer is nearly transparent to the electron beam of the microscope and reveals in the forms of a mottle the matrix structure therebeneath. In places marked B, the polarity control layer is thicker because there the polyurea is diffused from some distance into the body of the particle and forms the actual matrix in conjunction with the mainly acyl urea reaction product between the isocyanate and the matrix-forming co-reactant.

In FIG. 2 is shown the cross-section of a spherical toner particle embedded in a potting resin. As both the polyurea forming the polarity control layer and the potting resin are polymers, they produce only negligible emission contrast under the electron beam of the microscope, hence the actual thickness of the polarity control layer is not detectable. The diffusion of the polyurea forming the polarity control layer into the body of the particle, and the matrix structure as a continuum of such layer can be, however, clearly seen, for instance, where indicated by the letter C, which is representative of the area marked B in FIG. 1. Discontinuities throughout the body of the particle created by the matrix formed by the acyl urea reaction product between the isocyanate and the matrix-forming co-reactant are clearly shown, for instance, where marked D.

On the basis of the considerations outlined in the foregoing, toners can be formulated to produce on plain paper receptor image deposits which can be fixed at pressure within the range 90–130 pounds per lineal inch.

In certain commercially available office copiers equipped with toner applicators adapted to tribocharge the toner, such as, for instance, single component toner applicators comprising a multi-magnet toning roller having an outer sleeve of synthetic oxide and a copper alloy doctor blade, or two component toner applicators wherein the toner is admixed with certain types of strongly tribocharging carrier material to form a developer, the particle charge level may be too high for the attainment of acceptable copy quality if the outer surface of the toner particles comprises polyurea only. Such high particle charge levels may be reduced to levels which allow the production of high quality copies by the addition of an organic fluorochemical compound, commonly referred to as a surfactant, which in addition to controlling the particle charge levels, also acts as flow improver. Such materials normally comprise an insoluble organofluoro tail and a solubilizing end which may comprise groups which are hydrophilic or organophilic, at least partially water soluble and at least partially soluble in isocyanate or some other component of the sphere material, or reactive with isocyanate. In accordance with this invention such materials can be included in a simple yet effective manner to become firmly bonded to the polyurea polarity control surface layer of the toner particles.

The organic fluorochemical compounds useful in accordance with this invention are surfactants which are at least partially water soluble, have a solubilizing end comprising hydrophilic or organophilic groups which can be attached or bonded to the spheres by adsorption, or by at least partial solution in a sphere component and/or in isocyanate, or by reaction with isocyanate, and an insoluble organofluoro tail which is the active particle charge controller or modifier and flow improver. Examples of such compounds which are at least partially soluble in a sphere component and/or isocyanate are fluorinated alkyl esters, potassium perfluoroalkyl sulfonates, potassium fluorinated alkyl carboxylates, ammonium perfluoroalkyl sulfonates and carboxylates, and fluorinated alkyl alkoxylate. Examples of such compounds which can react with isocyanate are, for instance, fluorinated alkyl polyoxyethylene ethanols and amine perfluoroalkyl sulfonates.

Prior to, or during, the initial states of hydrolysis-initiated formation of polyurea surface layer, organic fluorochemical attaches or bonds onto the surface of spheres at the solubilizing end thereof either by dissolving at least in part the hydrophilic or organophilic group thereof in (1) a component of the sphere material, or (2) isocyanate which is at or near the sphere surface in non-hydrolyzed state, or by reacting at least in part the hydrophilic or organophilic or reactive groups thereof with the isocyanate which is at or near the sphere surface in non-hydrolyzed state.

The organic fluorochemical is added to the aqueous phase upon formation of the emulsion of spheres but before completion of the hydrolysis-initiated formation of the polyurea surface layer. In batch type emulsifying equipment, the emulsion is formed within a few seconds after addition of the isocyanate-containing sphere-forming material to the aqueous phase, and, depending on the type of isocyanate used, the formation of the hydrolysis-initiated polyurea surface layer is relatively advanced within a period of about 2 seconds to about 5 minutes thereafter. Thus, depending on the type of isocyanate used in batch type equipment, the organic fluorochemical compounds should be added to the aqueous phase within a period of 2 seconds to about 4 minutes after formation of the emulsion of spheres. In in-line or continuous type equipment, the formation of the emulsion of spheres is virtually instantaneous and such emulsion is fed into a holding tank where, under agitation, the hydrolysis-initiated polyurea surface layer and at least in part the matrix formation are completed. Thus, again, depending on the type of isocyanate used, in in-line or continuous type emulsifying equipment, the organic fluorochemical compound is added to the holding tank prior to or simultaneously with feeding the emulsion of microspheres into same or in a period not exceeding about 4 minutes after commencement of such feeding.

Preferably, the formation of polarity control layers, the attachment or bonding of the organic fluorochemical compound to the microspheres, and at least in part the matrix-forming reaction between the isocyanate and the matrix-forming co-reactant should occur after completion of the emulsifying process within a period of about 4 hours, depending on the materials chosen, during which time the emulsion is kept agitated or stirred at slow speed. This results in a dispersion of microspheres in the aqueous phase containing the emulsifying agent therein in dissolved state and such microspheres contain the polyurea polarity control layer, the matrix as a continuum of such layer, and the organic fluorochemical charge control or modifying agent and flow improver firmly bonded or attached thereto.

Upon completion of part of hydrolysis of isocyanate to form polyurea, and reaction with reactive groups in the solubilizing end of the organic fluorochemical compound, in those instances where such reactive groups are present, and optionally upon completion of the reaction between the remainder of isocyanate and the matrix-forming co-reactant, the emulsifying agent is removed from the dispersion by washing. Such step of washing of course does not remove the organic fluorochemical which has now been firmly attached or bonded to the spheres and forms an integral part thereof. Following the step of washing, the water is removed from the dispersion to obtain dry toner particles having the insoluble organofluoro tail, i.e. the active charge controlling or modifying agent and flow improving part of the organic fluorochemical compound, firmly attached or bonded thereto.

By having the solubilizing end of said organic fluorochemical at least in part dissolved in a component of the sphere material or in isocyanate or reacted with isocyanate, the thus produced dry toner particles contain the insoluble organofluoro tail of said organic fluorochemical as the active charge controlling or modifying agent and flow improving portion thereof being firmly attached or bonded or adhered to the surface of the dry toner particles or combined therewith.

If, for instance, such organic fluorochemical compound is of the fluorinated alkyl ester type having an organophilic, or, more specifically, an oleophilic group, just prior to or during the polyurea formation, such oleophilic group becomes firmly attached by adsorption to the spheres because of the presence of one or more oleophilic components in the sphere material, whereas if such organophilic group is soluble in a component of the sphere material and/or in isocyanate, just prior to or during the polyurea formation, such organophilic group becomes firmly attached to the spheres by at least in part dissolving in a sphere material component and/or in isocyanate which is at or near the sphere surface in nonhydrolyzed state. Alternatively, if the organic fluorochemical compound is, for instance, of the amine perfluoroalkyl sulfonate type having an amine-containing solubilizing group which is reactive with isocyanate, just prior to or during the polyurea formation, such group becomes firmly bonded to the sphere by reacting with the isocyanate which is at or near the sphere surface in non-hydrolyzed state. The remainder of the isocyanate, that is, nonreacted isocyanate just beneath the sphere surface in the zone containing diffused polyurea and the isocyanate in the body of the sphere, reacts with the matrix-forming co-reactant, forming a matrix of a reaction product, preferably of the acylurea type (when the co-reactant is a vegetable oil or synthetic drying oil), as a continuum of said polyurea surface layer to thereby substantially solidify the sphere material. The distance beneath the sphere surface to which the zone containing both diffused polyurea and reaction product of isocyanate and matrix-forming co-reactant as a continuum extends, depends on specific factors as will be disclosed below.

It is also possible to add an organic fluorochemical compound to the dispersion after the emulsifying agent has been removed by washing. The compound is preferably admixed with the particles by agitation to ensure homogeneous distribution thereof throughout the dispersion. The required quantity of such compound is prepared as a dilute solution in water, together with water miscible solvents, if required in specific instances, as will be described below, and such dilute solution is poured slowly into the dispersion with constant stirring. Such stirring is continued for at least 30 minutes to insure homogenisation of the dispersion with the added flow improver, during which time the soluble end of the flow improver molecules becomes attached to the surface of the spheres by various mechanisms. The reason for such attachment is not clear, but it appears possible that potassium and ammonium salts and ethanol groups become attached to residual acid groups within the matrix-forming co-reactant near the surface of the spheres, amine groups react with small traces of residual isocyanate at the sphere surface, and alkyl esters become dissolved by residual isocyanate or non-reactive plasticiser such as dibutyl phthalate near the sphere surface. Alternatively attachment may be by simple adsorption, which is defined as adherence of the atoms, ions, or molecules of a gas or liquid to the surface of another substance. In most instances adsorption appears a very likely mechanism. The organic fluorochemical compound is adsorbed onto the surface of the microspheres, after which the water is removed from the dispersion to obtain dry toner particles.

The spherical toners of this invention may be used directly as dry toners for electrostatography or may be further admixed with flow improvers such as colloidal silica, aluminum silicate and the like, if desired. Additionally polarity or charge control or tribocharging agents such as nigrosine dyes and the like and conductivity enhancing agents such as carbon black may also be used.

It will be realized that the teachings of this invention apply to other pressure-fixable toner particles in addition to the single component magnetic type as referred to in the foregoing. For instance, single component pressure-fixable non-magnetic type toners for use in non-magnetic toner applicators, as well as two component pressure-fixable toners adapted to be admixed with carrier material to form a developer which is applied by cascading or magnetic brush applicator, as is well known in the art, can be prepared advantageously in accordance with the principles of this invention, as will be described further below.

The following examples are included to further illustrate the present invention.

EXAMPLE 1

A toner composition was prepared as follows:

| | |
|---|---|
| Beeswax, melting point 63° C. | 17 grams |
| Safflower oil | 21 grams |
| Magnetite, pH value 9, pigment grade | 62 grams |

The beeswax pressure-fixable material and safflower oil matrix-forming co-reactant were heated to 70° C. and blended. The magnetite was then added and the mixture transferred to a heated Cowles dissolver and milled for 3 hours at a temperature of 90°–120° C. The composition was then allowed to cool to 70° C.

33 grams, that is, 25 percent by weight of total solids, of polymethylene polyphenylisocyanate, a reactive type with NCO content of 31.3 percent by weight, was added and intimately mixed with the above composition by means of a high speed stirrer. The viscosity of this mixture at 60° C. was about 4,000 centipoise.

The aqueous phase comprised 400 grams of the emulsifying agent sodium dodecylbenzenesulphonate dissolved in 20 liters of demineralized water heated to 60° C. The composition containing the reactive isocyanate was added slowly to the aqueous phase and stirred for 2 minute with a higher shear Waring blender. This produced an emulsion of spherical particles, generally within the size range 10–25 microns. The high shear blender was then replaced with a low speed stirrer, and the emulsion was stirred for a further 3 hours, during which time a polyurea polarity control layer was formed around the spherical particles by hydrolysis-initiated polymerization of the portion of the isocyanate at or near the surface of the spheres. During this time a reaction also commenced between the remainder of the isocyanate and the fatty acids of the safflower oil to form an acyl polyurea matrix throughout the particles.

The so formed dispersion was then decant washed twice to remove practically all of the sodium dodecylbenzenesulphonate. The washed dispersion was then spray dried in a Niro P6. 3 spray drier, outlet temperature 130° C., to produce a dry powder toner of particle size generally within the range 10–25 microns.

The spray dried particles, which contained about 50 percent by weight magnetite, were used as single component magnetic toner applied by means of a rotating multi-magnet applicator in a conventional electrophotographic plain paper copier with selenium as the photoconductor. The toner was of negative polarity or negatively tribocharging, as evidenced by the sharpness of the developer latent images formed by positive electrostatic charges on the selenium photoconductor. The toner deposit formed on the selenium photoconductor was electrostatically transferred to plain paper and fixed thereon by passing the paper sheet between a pair of pressure rollers.

Due to the relatively high proportion of isocyanate used, that is, 25 percent by weight of total solids, the reaction between the isocyanate and the fatty acids in the safflower oil was nearly complete, and this resulted in a relatively rigid matrix. Consequently, particle disintegration upon application of pressure was not complete, and thus image deposits produced with this toner on plain paper were barely adequately fixed at pressure of 120 pounds per lineal inch.

EXAMPLE 2

Example 1 was repeated with the exception that the isocyanate content was reduced to 13.5 grams, or 11.9 percent by weight of total solids. The viscosity of the mixture at 60° C. was 4600 centipoise. In this instance sufficient of the fatty acids contained in the safflower oil remained unreacted to form a relatively plastic matrix. This enhanced particle disintegration whereby image deposits produced with this toner could be fixed at a pressure of 90 pounds per lineal inch when evaluated as in Example 1.

EXAMPLE 3

A toner composition was prepared as follows:

| | |
|---|---|
| Beeswax, melting point 63° C. | 14 grams |
| Safflower oil | 17 grams |
| Spindle oil, plasticizer | 7 grams |
| Magnetite, pH value 9, pigment grade | 62 grams |

The beeswax pressure-fixable material, the safflower oil matrix-forming co-reactant, and the spindle oil non-reactive plasticizer were heated to 70° C. and blended. The magnetite was then added and the mixture transferred to a heated Cowles dissolver and milled for 3 hours at a temperature of 90°–120° C. The composition was then allowed to cool to 70° C.

33 grams, that is, 25 percent by weight of total solids, of polymethylene polyphenylene isocyanate as in Example 1 was added and intimately mixed with the above composition by means of a high speed stirrer. The viscosity of this mixture at 60° C. was about 3,700 centipoise.

The aqueous phase, emulsification therein of the isocyanate containing composition, washing of the resulting dispersion and spray drying same, were as in Example 1.

Even though the reactive isocyanate comprised 25 percent by weight of total solid, the presence of spindle oil plasticizer in a proportion of about 5 percent by weight of total solids allowed image deposits produced with this toner to be fixed at an applied fixing pressure of 90 pounds per lineal inch, when evaluated as in Example 1.

EXAMPLES 4–6

Each of Examples 1–3 was repeated, with the exception that the polymethylene polyphenylisocyanate was replaced in each instance with an equal weight of 4–4'-diphenylmethane diisocyanate. The dry toner particles appeared to have a more pronounced charge control layer than those of Examples 1–3 and a somewhat more plastic or less reacted matrix. Fixing pressures were marginally lower than those of Examples 1–3.

EXAMPLES 7–12

Each of Examples 1–6 was repeated, with the exception that the beeswax in the core composition was replaced with paraffin wax, melting range 57° C. to 60° C.

EXAMPLES 13–24

Each of Examples 1–12 was repeated, with the exception that the aqueous phase comprised an equal quantity of a 1 percent by weight solution of a sodium salt of styrene maleic anhydride.

EXAMPLES 25–36

Each of Examples 1–12 was repeated, with the exception that the aqueous phase comprised an equal quantity of a 1 percent by weight solution of sodium lignin sulphonate.

EXAMPLES 37–48

Each of Examples 1–12 was repeated, with the exception that the aqueous phase comprised an equal quantity of a 0.3 percent by weight solution of ethylene maleic anhydride, EMA-31 produced by Monsanto Company.

EXAMPLE 49

A two component pressure-fixable black toner composition was prepared as follows:

| | |
|---|---|
| Paraffin wax, melting range 57–60° C. | 25 grams |
| Safflower oil | 20 grams |
| Spindle oil, plasticizer | 15 grams |
| Carbon black pigment | 15 grams |
| Aniline black pigment | 25 grams |

The paraffin wax pressure-fixable material, the safflower oil matrix-forming co-reactant, and the spindle oil were heated to 70° C. and blended. The carbon black and aniline black pigments were added, and the mixture transferred to a heated Cowles dissolver and milled for 3 hours at a temperature of 90°–120° C. The composition was then allowed to cool to 70° C.

The reactive isocyanate of Example 1 (33 grams) was added and intimately mixed with the above composition by means of a high speed stirrer. The viscosity of this mixture was about 5000 centipoise at 60° C.

The composition was emulsified, washed, and dried as in Example 1 to produce toner particles of particle size generally within the range 10–15 microns, which were subsequently mixed with carrier material to form a two component toner which was applied by means of cascading onto the selenium photoconductor in a conventional plain paper copier. The toner was of negative polarity or negatively tribocharging, as evidenced by the sharpness of the developed latent images formed by positive electrostatic charges on the selenium photoconductor. The toner deposits formed on the photoconductor were electrostatically transferred onto plain paper and fixed thereon by passing the paper sheet between a pair of pressure rollers. Because of matrix-induced particle disintegration upon application of pressure and the presence of the spindle oil plasticizer in the toner composition, image deposits produced with this toner were fixed at an applied fixing pressure of 100 pounds per lineal inch.

EXAMPLE 50

Example 49 was repeated with the exception that the carbon black and aniline black pigments were replaced with 40 grams of phthalocyanine blue pigment. This resulted in a two component pressure-fixable cyan toner.

EXAMPLE 51

Example 49 was repeated with the exception that the carbon black and aniline black pigments were replaced with 40 grams of barium lithol red pigment. This resulted in a two component pressure-fixable magenta toner.

EXAMPLE 52

Example 49 was repeated with the exception that the carbon black and aniline black pigments were replaced with 40 grams of hansa yellow pigment. This resulted in a two component pressure-fixable yellow toner.

EXAMPLE 53

Example 1 was repeated with the exception that the magnetite was replaced with an equal weight of brown granular ferrite, axial ratio 1:1, particle size 0.65 micron, to produce a brown shade single component magnetic toner.

EXAMPLE 54

Example 1 was repeated with the exception that the magnetite was replaced with 50 grams of the granular ferrite of Example 53 and 12 grams of CI Pigment Red 57 to produce a red shade single component magnetic toner.

EXAMPLE 55

Example 1 was repeated with the exception that the magnetite and safflower oil were first milled together at a temperature of 170° C. maximum on triple roll mill, after which the melted beeswax was added, and the mixture homogenized with a high speed stirrer. The resulting composition was mixed with isocyanate, emulsified, washed, and spray dried as in Example 1.

EXAMPLES 56–58

Each of Examples 1–3 was repeated, with the exception that the beeswax pressure-fixable material was replaced with an equal weight of a polyethylene wax, melting point 35° C. The viscosities of the three compositions with admixed isocyanate were 5,500, 6,200, and 5,200 centipoise, respectively. The fixing pressures required were also higher, namely 130, 120, and 110 pounds per lineal inch, respectively, when the toners were tested as in Example 1.

EXAMPLE 59

A single component non-magnetic pressure-fixable color toner composition was prepared as follows.

| | |
|---|---|
| Paraffin wax, melting range 57–60° C. | 30 grams |
| Safflower oil | 20 grams |
| Spindle oil, plasticizer | 10 grams |
| Phthalocyanine blue pigment | 40 grams |

The paraffin wax pressure fixable material, the safflower oil matrix-forming co-reactant, and the spindle oil were heated to 70° C. and blended. The phthalocyanine blue pigment was added and the mixture transferred to a heated Cowles dissolver and milled for 3 hours at a temperature of 90°–120° C. The composition was then allowed to cool to 70° C.

The reactive isocyanate of Example 1 (33 grams) was added and intimately mixed with the above composition by means of a high speed stirrer. The viscosity of this mixture was about 5,500 centipoise at 60° C.

The composition was emulsified, washed, and dried as in Example 1 to produce toners of particle size generally within the range 10–25 microns.

The toner was applied to a selenium photoconductor in a plain paper copier using a toning unit of the general type as in U.S. Pat. No. 4,232,628 of Shelffo. The toner was of negative polarity or negatively tribocharging, as evidenced by the sharpness of the developed latent images, produced by positive electrostatic charges on the selenium photoconductor. The toner deposits formed on the photoconductor were electrostatically transferred onto plain paper and fixed thereon by passing the paper sheet between a pair of pressure rollers. Because of matrix-induced particle disintegration upon application of pressure and the presence of the spindle oil plasticizer in the toner composition, image deposits produced with this toner were fixed at an applied fixing pressure of 100 pounds per lineal inch.

EXAMPLE 60

ExampIe 59 was repeated wIth the exception that the phthalocyanine blue pigment was replaced with 40 grams of barium lithol red pigment. This resulted in a non-magnetic single component pressure-fixable magenta toner.

EXAMPLE 61

A toner composition was prepared as follows:

| | |
|---|---|
| Bitumen, melting range 80–90° C. | 17 grams |
| Safflower oil | 21 grams |
| Magnetite, pH value 9, pigment grade | 62 grams |

The bitumen pressure-fixable material and safflower oil matrix-forming co-reactant were heated to 90° C. and blended. The magnetite was then added and the mixture transferred to a heated Cowles dissolver and milled for 3 hours at a temperature of 110°–150° C. The composition was then allowed to cool to 70° C.

33 grams, that is, 25 percent by weight of total solids, of polymethylene polyphenylisocyanate, a reactive type with NCO content of 31.3 percent by weight, was added and intimately mixed with the above composition by means of a high speed stirrer. The viscosity of this mixture at 60° C. was about 7,000 centipoise.

The aqueous phase comprised 400 grams of the emulsifying agent sodium dodecylbenzenesulphonate dissolved in 20 liters of demineralized water heated to 60° C. The composition containing the reactive isocyanate was added slowly to the aqueous phase and stirred for 2 minutes with a high shear Waring blender. This produced an emulsion of spherical particles generally within the size range 10–25 microns. The high shear blender was then replaced with a low speed stirrer, and the emulsion was stirred for a further 3 hours, during which time a polyurea polarity control layer was formed around the spherical particles by hydrolysis-initiated polymerization of the portion of the isocyanate at or near the surface of the spheres. During this time a reaction also commenced between the remainder of the isocyanate and the fatty acids of the safflower oil to form an acyl polyurea matrix throughout the particles.

The so formed dispersion was then decant washed twice to remove practically all of the sodium dodecylbenzenesulphonate. The washed dispersion was then spray dried in a Niro P6. 3 spray drier, outlet temperature 130° C., to produce a dry powder toner of particle size generally within the range of 10–25 microns.

The spray dried particles, which contained about 50 percent by weight magnetite, were used as a single component magnetic toner applied by means of a rotating multi-magnet applicator in a conventional electrophotographic plain paper copier with selenium as the photoconductor. The toner was of negative polarity or negatively tribocharging, as evidenced by the sharpness of the developed latent images formed by positive electrostatic charges on the selenium photoconductor. The toner deposit formed on the selenium photoconductor was electrostatically transferred to plain paper and fixed thereon by passing the paper sheet between a pair of pressure rollers.

Due to the relatively high proportion of isocyanate used, that is, 25 percent by weight of total solids, the reaction between the isocyanate and the fatty acids in the safflower oil was nearly complete, and this resulted in a relatively rigid matrix. Consequently, particle disintegration upon application of pressure was not complete, and thus image deposits produced with this toner on plain paper were barely adequately fixed at pressure of 110 pounds per lineal inch.

EXAMPLE 62

Example 61 was repeated with the exception that the isocyanate content was reduced to 13.5 grams, or 11.9 percent by weight of total solids. The viscosity of the mixture at 60° C. was 7500 centipoise. In this instance sufficient of the fatty acids contained in the safflower oil remained unreacted to form a relatively plastic matrix. This enhanced particle disintegration, whereby image deposits produced with this toner could be fixed at a pressure of 90 pounds per lineal inch when evaluated as in Example 1.

EXAMPLE 63

A toner composition was prepared as follows:

| | |
|---|---|
| Bitumen, melting point 80–90° C. | 14 grams |
| Safflower oil | 17 grams |
| Spindle oil | 7 grams |
| Magnetite, pH value 9, pigment grade | 62 grams |

The bitumen pressure-fixable material, the safflower oil matrix-forming co-reactant, and the spindle oil non-reactive plasticizer were heated to 90° C. and blended. The magnetite was then added and the mixture transferred to a heated Cowles dissolver and milled for 3 hours at a temperature of 110°–150° C. The composition was then allowed to cool to 70° C.

33 grams, that is, 25 percent by weight of total solids, of polymethylene polyphenylene isocyanate as in Example 1, was added and intimately mixed with the above composition by means of a high speed stirrer. The viscosity of this mixture at 60° C. was about 6,500 centipoise.

The aqueous phase, emulsification therein of the isocyanate containing composition, washing of the resulting dispersion, and spray drying same, were as in Example 61.

Even though the reactive isocyanate comprised 25 percent by weight of total solids, the presence of spindle oil plasticizer in a proportion of about 5 percent by weight of total solids allowed image deposits produced with this toner to be fixed at an applied fixing pressure of 100 pounds per lineal inch, when evaluated as in Example 61.

EXAMPLE 64–66

Each of Examples 61–63 was repeated, with the exception that the bitumen, melting range 80°–90° C. was replaced with a bitumen with a melting range 44°–51° C. This reduced the sphere composition/isocyanate mixture viscosities at 60° C. to 3500, 4000, and 3000 centipoise, respectively, and allowed image deposits produced with these toners to be fixed by applied pressures of 100, 80, and 80 pounds per lineal inch, respectively.

EXAMPLES 67–69

Each of Examples 61-63 was repeated with the exception that the pressure fixable toner composition comprised the following:

| | |
|---|---|
| Bitumen, melting range 80–90° C. | 12 grams |
| Paraffin wax, melting range 57–60° C. | 5 grams |
| Safflower oil | 21 grams |
| Magnetite, pH value 9, pigment grade | 62 grams |

The presence of the paraffin wax, which was liquid at 60° C., allowed the viscosities of the three toner compositions after admixture with the isocyanate to be somewhat lower at 60° C. that those of Examples 61–63, and the fixing pressures necessary to fix toned image deposits produced with these toners were also marginally lower than those of Examples 61–63.

EXAMPLES 70–78

Each of Example 61–69 was repeated, with the exceptions that the polymethylene polyphenylisocyanate was replaced in each instance with an equal weight of 4,4'-diphenylmethane diisocyanate. The dry toner particles appeared to have a more pronounced charge control layer than those of Examples 61–69 and a somewhat more plastic or less reacted matrix. Fixing pressures were marginally lower than those of Examples 61–69.

EXAMPLES 79–96

Each of Examples 61–78 was repeated, with the exception that the aqueous phase comprised an equal quantity of a 1 percent by weight solution of a sodium salt of styrene maleic anhydride.

EXAMPLES 97–114

Each of Examples 61–78 was repeated, with the exception that the aqueous phase comprised an equal quantity of a 1 percent by weight solution of sodium lignin sulphonate.

EXAMPLES 115–132

Each of Examples 61-78 was repeated, with the exception that the aqueous phase comprised an equal quantity of a 0.3 percent by weight solution of ethylene maleic anhydride, EMA-31 produced by Monsanto Company.

EXAMPLE 133

A two component pressure-fixable toner composition was prepared as follows:

| | |
|---|---|
| Bitumen, melting range 44–51° C. | 25 grams |
| Safflower oil | 20 grams |
| Spindle oil, plasticizer | 15 grams |
| Carbon black pigment | 15 grams |
| Aniline black pigment | 25 grams |

The bitumen pressure-fixable material, the safflower oil matrix-forming co-reactant, and the spindle oil were heated to 70° C. and blended. The carbon black and aniline black pigments were added and the mixture transferred to a heated Cowles dissolver and milled for 3 hours at a temperature of 80°–120° C. The composition was then allowed to cool to 70° C.

The reactive isocyanate of Example 61 (33 grams) was added and intimately mixed with the above composition by means of a high speed stirrer. The viscosity of this mixture was about 4500 centipoise at 60° C.

The composition was emulsified, washed, and dried as in Example 61 to produce toner particles of particle size generally within the range 10–15 microns, which were subsequently mixed with carrier material to form a two component developer which was applied by means of cascading onto the selenium photoconductor in a conventional plain paper copier. The toner was of negative polarity or negatively tribocharging, as evidenced by the sharpness of the developed latent images formed by positive electrostatic charges on the selenium photoconductor. The toner deposits formed on the photoconductor were electrostatically transferred onto plain paper and fixed thereon by passing the paper sheet between a pair of pressure rollers. Because of matrix-induced particle disintegration upon application of pressure and the presence of the spindle oil plasticizer in the toner composition, image deposits produced with this toner were fixed at an applied fixing pressure of 90 pounds per lineal inch.

EXAMPLE 134

Example 61 was repeated with the exception that the magnetite and safflower oil were first milled together at a temperature of 170° C. maximum on a triple roll mill, after which the melted bitumen was added and the mixture homogenized with a high speed stirrer. The resulting composition was mixed with isocyanate, emulsified, washed, spray dried, and used as toner as in Example 61.

EXAMPLE 135

A single component non-magnetic pressure-fixable toner composition was prepared as follows.

| | |
|---|---|
| Bitumen, melting range 44–51° C. | 30 grams |
| Safflower oil | 20 grams |
| Spindle oil, plasticizer | 10 grams |
| Carbon Black pigment | 15 grams |
| Aniline black pigment | 25 grams |

The bitumen pressure-fixable material, the safflower oil matrix-forming co-reactant, and the spindle oil were heated to 70° C. and blended. The carbon black and aniline black pigments were added and the mixture transferred to a heated Cowles dissolver and milled for 3 hours at a temperature of 80°–120° C. The composition was then allowed to cool to 70° C.

The reactive isocyanate of Example 61 (33 grams) was added and intimately mixed with the above composition by means of a high speed stirrer. The viscosity of this mixture was about 5,000 centipoise at 60° C.

The composition was emulsified, washed and dried as in Example 61 to produce toners of particle size generally within the range 10–25 microns.

The toner was applied to a selenium photoconductor in a plain paper copier using a toning unit of the general type as in U.S. Pat. No. 4,232,628 of Shelffo. The toner was of negative polarity or negatively tribocharging, as evidenced by the sharpness of the developed latent images, produced by positive electrostatic charges on the selenium photoconductor. The toner deposits formed on the photoconductor were electrostatically transferred onto plain paper and fixed thereon by passing the paper sheet between a pair of pressure rollers. Because of matrix-induced particle disintegration upon application of pressure and the presence of the spindle oil plasticizer in the toner composition, image deposits produced with this toner were fixed at an applied fixing pressure of 100 pounds per lineal inch.

EXAMPLE 136

A toner composition was prepared as follows:

| | |
|---|---|
| Beeswax, melting point 63° C. | 17 grams |
| Safflower oil | 21 grams |
| Magnetite, pH value 9, pigment grade | 62 grams |

The beeswax pressure-fixable material and safflower oil matrix-forming co-reactant were heated to 70° C. and blended. The magnetite was then added and the mixture transferred to a heated Cowles dissolver and milled for 3 hours at a temperature of 90°–120° C. The composition was then allowed to cool to 70° C.

33 grams, that is, 25 percent by weight of total solid, of polymethylene polyphenylisocyanate, a reactive type with NCO content of 31.3 percent by weight, was added and intimately mixed with the above composition by means of a high speed stirrer. The viscosity of this mixture at 60° C. was about 4000 centipoise.

The aqueous phase comprised 200 grams of the emulsifying agent sodium lignin sulphonate dissolved in 20 liters of demineralized water. Also dissolved therein was 0.27 gram of a fluorinated alkyl ester, "Fluorad" FC-430 (trade name), made by Minnesota Mining and Manufacturing Co., having an organophilic solubilizing end which is isocyanate soluble. The aqueous phase was heated to 60° C. and the composition containing the reactive isocyanate was added slowly to the aqueous phase and stirred for 2 minute with a high shear Waring blender. This produced an emulsion of spherical particles generally within the size range 10–25 microns. The high shear blender was then replaced with a low speed stirrer, and the emulsion was stirred for a further 3 hours, during which time a polyurea polarity control layer was formed around the spherical particles by hydrolysis-initiated polymerization of the portion of the isocyanate at or near the surface of the spheres. In addition, the organophilic solubilizing end of the fluorinated alkyl ester molecules became attached to the spheres and firmly bonded thereto by dissolving in said isocyanate before hydrolysis had proceeded to any substantial extent. During this time a reaction also commenced between the remainder of the isocyanate and the fatty acids of the safflower oil to form an acyl urea matrix throughout the particles.

The so formed dispersion was then decant washed twice to remove practically all of the sodium lignin sulphonate.

The washed dispersion was then spray dried in a Niro P6. 3 spray drier, outlet temperature 130° C., to produce a dry powder toner of particle size generally within the range 10–25 microns.

The spray dried particles, which contained about 50 percent by weight magnetite, were used as single component magnetic toner applied by means of a rotating multi-magnet applicator having a synthetic oxide surface and a copper alloy doctor blade in a conventional electrophotographic plain paper copier with selenium as the photoconductor. As evidenced by the sharpness and high density of the developed images formed by positive electrostatic charges on the selenium photoconductor, the toner was of negative polarity or negatively tribocharging and of correct particle charge level due to the presence on the particle surface of about 0.2 percent by weight organic fluorochemical charge modifying agent. The toner deposit formed on the selenium photoconductor was electrostatically transferred to plain paper and fixed thereon by passing the paper sheet between a pair of pressure rollers.

Due to the relatively high proportion of isocyanate used, that is, 25 percent by weight of total solids, the reaction between the isocyanate and the fatty acids in the safflower oil was nearly complete, and this resulted in a relatively rigid matrix. Consequently, particle disintegration upon application of pressure was not complete, and thus image deposits produced with this toner on plain paper were barely adequately fixed at pressure of 120 pounds per lineal inch.

EXAMPLE 137

Example 136 was repeated with the exception that the isocyanate content was reduced to 13.5 grams, or 11.9 percent by weight of total solids. The viscosity of the mixture at 60° C. was 4600 centipoise. In this instance sufficient of the fatty acids contained in the safflower oil remained unreacted to form a relatively plastic matrix. This enhanced particle distintegration whereby image deposits produced with this toner could be fixed at a pressure of 90 pounds per lineal inch when evaluated as in Example 1.

EXAMPLE 138

A toner composition was prepared as follows:

| | |
|---|---|
| Beeswax, melting point 63° C. | 14 grams |
| Safflower oil | 17 grams |
| Spindle oil, plasticizer | 7 grams |
| Magnetite, pH value 9, pigment grade | 62 grams |

The beeswax pressure-fixable material, the safflower oil matrix-forming co-reactant and the spindle oil non-reactive plasticizer were heated to 70° C. and blended. The magnetite was then added and the mixture transferred to a heated Cowles dissolver and milled for 3 hours at a temperature of 90-120° C. The composition was then allowed to cool to 70° C.

33 grams, that is, 25 percent by weight of total solids, of polymethylene polyphenylene isocyanate, as in Example 136, was added and intimately mixed with the above composition by means of a high speed stirrer. The viscosity of this mixture at 60° C. was about 3700 centipoise.

The aqueous phase, emulsification therein of the isocyanate containing composition, washing of the resulting dispersion, and spray drying same, were as in Example 136.

Even though the reactive isocyanate comprised 25 percent by weight of total solids, the presence of spindle oil plasticizer in a proportion of about 5 percent by weight of total solids, upon application of pressure, allowed image deposits produced with this toner to be fixed at an applied fixing pressure of 90 pounds per lineal inch, when evaluated as in Example 136.

EXAMPLE 139

A toner composition was prepared as follows:

| | |
|---|---|
| Bitumen, melting range 44–51° C. | 17 grams |
| Safflower oil | 21 grams |
| Magnetite, pH value 9, pigment grade | 62 grams |

The bitumen pressure-fixable material and the safflower oil matrix-forming co-reactant were heated to 70° C. and blended. The magnetite was then added and the mixture transferred to a heated Cowles dissolver and milled for 3 hours at a temperature of 90°–120° C. The composition was then allowed to cool to 70° C. and 13.5 grams of polymethylene polyphenylene isocyanate was added and intimately mixed therewith by means of a high speed stirrer. The viscosity of this mixture at 60° C. was about 4,000 centipoise.

The aqueous phase, emulsification therein of the isocyanate containing composition, washing of the resulting dispersion, and spray drying were as in Example 136.

Image deposits produced with this toner were fixed at an applied fixing pressure of 100 pounds per lineal inch when evaluated as in Example 136.

EXAMPLE 140

A two component pressure-fixable black toner composition was prepared as follows:

| | |
|---|---|
| Paraffin wax, melting range 57–60° C. | 25 grams |
| Safflower oil | 20 grams |
| Spindle oil, plasticizer | 15 grams |

-continued

| | |
|---|---|
| Carbon black pigment | 15 grams |
| Aniline black pigment | 25 grams |

The paraffin wax pressure-fixable material, the safflower oil matrix-forming co-reactant, and the spindle oil were heated to 70° C. and blended. The carbon black and aniline black pigments were added and the mixture transferred to a heated Cowles dissolver and milled for 3 hours at a temperature of 90-120° C. The composition was then allowed to cool to 70° C.

The reactive isocyanate of Example 136 (33 grams) was added and intimately mixed with the above composition by means of a high speed stirrer. The viscosity of this mixture was about 5000 centipoise at 60° C.

The composition was emulsified, washed, and dried as in Example 136 to produce toner particles of particle size generally within the range 10–15 microns, which were subsequently mixed with carrier material to form a two component toner which was applied by means of cascading onto the selenium photoconductor in a conventional plain paper copier. As evidenced by the sharpness and high density of the developed images formed by positive electrostatic charges on the selenium photoconductor, the toner was of negative polarity or negatively tribocharging and of correct particle charge level due to the presence of the charge modifying organic fluorochemical compound on the toner particle surfaces. The toner deposits formed on the photoconductor were electrostatically transferred onto plain paper and fixed thereon by passing the paper sheet between a pair of pressure rollers. Because of matrix-induced particle disintegration upon application of pressure and the presence of the spindle oil plasticizer in the toner composition, image deposits produced with this toner were fixed at an applied pressure of 100 pounds per lineal inch.

EXAMPLE 141

Example 140 was repeated with the exception that the carbon black and aniline black pigments were replaced with 40 grams of phthalocyanine blue pigment. This resulted in a two component pressure-fixable cyan toner.

EXAMPLE 142

Example 140 was repeated with the exception that the carbon black and aniline black pigments were replaced with 40 grams of barium lithol red pigment. this resulted in a two component pressure-fixable magenta toner.

EXAMPLE 143

A non-magnetic single component pressure fixable black toner composition was prepared as follows:

| | |
|---|---|
| Paraffin wax, melting range 57–60° C. | 30 grams |
| Safflower oil | 20 grams |
| Spindle oil, plasticizer | 10 grams |
| Carbon black pigment | 15 grams |
| Aniline black pigment | 25 grams |

The paraffin wax pressure-fixable material, the safflower oil matrix-forming co-reactant, and the spindle oil were heated to 70° C. and blended. The carbon black and aniline black pigments were added and the mixture transferred to a heated Cowles dissolver and milled for 3 hours at a temperature of 90°–120° C. The composition was allowed to cool to 70° C.

The reactive isocyanate of Example 136 (33 grams) was added and intimately mixed with the above composition by means of a high speed stirrer. The viscosity of this mixture was about 5500 centipoise at 60° C.

The composition was emulsified, washed, and dried as in Example 136 to produce toner particles of particle size generally within the range of 10–25 microns.

The toner was applied to a selenium photoconductor in a plain paper copier using a toning unit of the general type as in U.S. Pat. No. 4,232,628 of Shelffo. As evidenced by the sharpness and high density of the developed images formed by positive electrostatic charges on the selenium photoconductor, the toner was of negative polarity or negatively tribocharging and of correct particle charge level due to the presence of the charge modifying organic fluorochemical compound on the toner particle surfaces. The toner deposits formed on the photoconductor were electrostatically transferred onto plain paper and fixed thereon by passing the paper sheet between a pair of pressure rollers. Because of matrix-induced particle disintegration upon application of pressure and the presence of the spindle oil plasticizer in the toner composition, image deposits produced with this toner were fixed at an applied pressure of 100 pounds per lineal inch.

EXAMPLE 144

Example 143 was repeated, with the exception that the carbon black and aniline black pigments were replaced with 40 grams of phthalocyanine blue pigment. This resulted in a non-magnetic single component pressure-fixable cyan toner.

EXAMPLE 145

Example 143 was repeated, with the exception that the carbon black and aniline black pigments were replaced with 40 grams of barium lithol red pigment. This resulted in a non-magnetic single component pressure-fixable magenta toner.

EXAMPLE 146

Example 138 was repeated with the exception that the spindle oil non-reactive plasticizer was replaced with an equal weight of the plasticizer dibutyl phthalate.

The aqueous phase comprised 200 grams of the emulsifying agent sodium lignin sulfphonate and 0.54 grams of a fluorinated alkyl ester, "Fluorad" FC-431, (trade name), made by Minnesota Mining and Manufacturing Company, having an oleophilic solubilizing end which is dibutyl phthalate soluble, dissolved in 20 liters of water. FC-431 ester is supplied as a 50 percent by weight solution in ethyl acetate. The oleophilic solubilizing end of the FC-431 molecules became attached to the spheres and firmly bonded thereto by dissolving at least in part in the dibutyl phthalate plasticizer in the sphere composition near the sphere surface during emulsification and before the hydrolysis-initiated formation of the polyurea surface layer had proceeded to any substantial extent.

EXAMPLES 147–156

Each of Examples 136-145 was repeated with the exception that the "Fluorad" FC-430 fluorinated alkyl ester was replaced with 1.08 grams of an amine perfluoroalkyl sulphonate, "Fluorad" FC-99 (trade name)

made by Minnesota Mining and Manufacturing Company, having a solubilizing end which can react with isocyanate. "Fluorad" FC-99 sulphonate contains 25 percent active components; consequently the quantity used was increased to give the same final organic fluorochemical content as in Examples 136–145, about 0.2 percent. Before the hydrolysis-initiated formation of the polyurea surface layer had proceeded to any substantial extent, the solubilizing end of the "Fluorad" FC-99 molecules became firmly bonded to the spheres by the amine group in that end, reacting at least in part with non-hydrolyzed isocyanate.

EXAMPLES 157–166

Each of Examples 147–156 was repeated, with the exception that the "Fluorad" FC-430 fluorinated alkyl ester was replaced with an equal weight of a fluorinated alkyl polyoxyethylene ethanol, FC-170C (trade name) made by Minnesota Mining and Manufacturing Company, having a solubilizing end which can react with isocyanate. Before the hydrolysis-initiated formation of the polyurea surface layer had proceeded to any substantial extent, the solubilizing end of the "Fluorad" FC-170C molecules became firmly bonded to the spheres by the ethanol group in such end, reacting at least in part with non-hydrolyzed isocyanate.

The dried toners prepared in accordance with the above Examples 135–166 comprise substantially spherical particles containing an internal matrix, as a continuum thereof a polyurea polarity control layer which confers negative polarity onto such particles and an organic fluorochemical compound firmly attached or bonded thereto, serving the dual purpose of modifying the particle charge level and improving flow properties. The particles did not agglomerate. No contamination of the photoconductor was noted.

It will be noted that in each of Examples 135–166, the organic fluorochemical compound is added in a proportion of about 0.2 percent based on the dry weight of the toner. This has been found to be suitable particularly for single component magnetic toners to be used in plain paper copiers with a selenium photoconductor where the toner applicator magnet roller has a synthetic oxide surface and the doctor blade is of copper alloy, or for two components toners admixed with highly insulative and strongly tribocharging carrier material. For copying machines in which the toning unit has different materials of construction or where toner polarity or particle charge are defined by biasing means, this percentage may advantageously be changed. Generally, it appears that the quantity of organic fluorochemical compound can be varied within the range 0.01 percent to 1 percent by weight, preferably 0.05 percent to 0.5 percent by weight to obtain the combined advantageous effects of particle charge modification and improved flow characteristics.

EXAMPLE 167

A toner composition was prepared as follows:

| | |
|---|---|
| Beeswax, melting point 63° C. | 17 grams |
| Safflower oil | 21 grams |
| Magnetite, pH value 9, pigment grade | 62 grams |

The beeswax pressure-fixable material and safflower oil matrix-forming co-reactant were heated to 70° C. and blended. The magnetite was then added and the mixture transferred to a heated Cowles dissolver and milled for 3 hours at a temperature of 90°–120° C. The composition was then allowed to cool to 70° C.

33 grams, that is, 25 percent by weight of total solids, of polymethylene polyphenylisocyanate, a reactive type with NCO content of 31.3 percent by weight, was added and intimately mixed with the above composition by means of a high speed stirrer. The viscosity of this mixture at 60° C. was about 4,000 centipoise.

The aqueous phase comprised 200 grams of the emulsifying agent lignin sulphonate dissolved in 20 liters of demineralized water heated to 60° C. The composition containing the reactive isocyanate was added slowly to the aqueous phase and stirred for 2 minute with a high shear Waring blender. This produced an emulsion of spherical particles, generally within the size range 10–25 microns. The high shear blender was then replaced with a low speed stirrer, and the emulsion was stirred for a further 3 hours, during which time a polyurea polarity control layer was formed around the spherical particles by hydrolysis-initiated polymerization of the portion of the isocyanate at or near the surface of the spheres. During this time a reaction also commenced between the remainder of the isocyanate and the fatty acid of the safflower oil to form an acyl urea matrix throughout the particles.

The so formed dispersion was then decant washed twice to remove practically all of the sodium lignin sulphonate. A solution containing 0.27 grams of a fluorinated alkyl ester, "Fluorad" FC-430, dissolved in 50 milliliters of water, was then added slowly with constant stirring. FC-430 ester has an organophilic solubilising end which is soluble in various organic materials including polymeric isocyanate. It is believed that either polymeric isocyanate remained near the surface of the spheres in sufficient quantity to allow the attachment thereto of the organic fluorochemical compound by at least partial solution of the organophilic solubilising end in such residual polymeric isocyanate or the organophilic solubilising end of the molecule became adsorbed to the sphere surface.

The thus treated dispersion was then spray dried in a Niro P6. 3 spray drier, outlet temperature 130° C., to produce a dry powder toner of particle size generally within the range 10–25 microns with the organic fluorocarbon compound flow improver firmly attached thereto The spray dried particles, which contained about 50 percent by weight magnetite, were used as single component magnetic toner, applied by means of a rotating multi-magnet applicator having a synthetic oxide surface and a copper alloy doctor blade in a conventional electrophotographic plain paper copier with selenium as the photoconductor. The toner was of negative polarity or negatively tribocharging as evidenced by the sharpness of the developer latent images formed by positive electrostatic charges on the selenium photoconductor. The toner deposit formed on the selenium photoconductor was electrostatically transferred to plain paper and fixed thereon by passing the paper sheet between a pair of pressure rollers.

Due to the relatively high proportion of isocyanate used, that is, 25 percent by weight of total solids, the reaction between the isocyanate and the fatty acids in the safflower oil was nearly complete, and this resulted in a relatively rigid matrix. Consequently, particle disintegration upon application of pressure was not complete, and, thus, image deposits produced with this toner on plain paper were barely adequately fixed at pressure of 120 pounds per lineal inch.

Repeated copier testing showed the flow properties of the toner to be satisfactory, and no deterioration in flow properties was noted with repeated use of the toner, indicating firm attachment of the flow improver to the toner particles.

EXAMPLE 168

Example 167 was repeated with the exception that the isocyanate content was reduced to 13.5 grams, or 11.9 percent by weight of total solids. The viscosity of the mixture at 60° C. was 4600 centipoise. In this instance sufficient of the fatty acids contained in the safflower oil remained unreacted to form a relatively plastic matrix. This enhanced particle disintegration whereby image deposits produced with this toner could be fixed at a pressure of 90 pounds per lineal inch when evaluated as in Example 167.

EXAMPLE 169

A toner composition was prepared as follows:

| | |
|---|---|
| Beeswax, melting point 63° C. | 14 grams |
| Safflower oil | 17 grams |
| Spindle oil, plasticizer | 7 grams |
| Magnetite, pH value 9, pigment grade | 62 grams |

The beeswax pressure-fixable material, the safflower oil matrix-forming co-reactant, and the spindle oil non-reactive plasticizer were heated to 70° C. and blended. The magnetite was then added and the mixture transferred to a heated Cowles dissolver and milled for 3 hours at a temperature of 90°–120° C. The composition was then allowed to cool to 70° C.

33 grams, that is, 25 percent by weight of total solids, of polymethylene polyphenylene isocyanate as in Example 167 was added and intimately mixed with the above composition by means of a high speed stirrer. The viscosity of this mixture at 60° C. was about 3,700 centipoise. The aqueous phase, emulsification therein of the isocyanate containing composition, washing of the resulting dispersion, organic fluorochemical compound addition, and spray drying, were as in Example 167.

Even though the reactive isocyanate comprised 25 percent by weight of total solid, the presence of spindle oil plasticizer in a proportion of about 5 percent by weight of total solids upon application of pressure, allowed image deposits produced with this toner to be fixed at an applied fixing pressure of 90 pounds per lineal inch, when evaluated as in Example 167.

EXAMPLE 170

A toner composition was prepared as follows:

| | |
|---|---|
| Bitumen, melting point 44–51° C. | 17 grams |
| Safflower oil | 21 grams |
| Magnetite, pH value 9, pigment grade | 62 grams |

The bitumen pressure-fixable material and safflower oil matrix-forming co-reactant, were heated to 70° C. and blended. The magnetite was then added, and the mixture transferred to a heated Cowles dissolver and milled for 3 hours at a temperature of 90°–120° C. The composition was then allowed to cool to 70° C.

13.5 grams, that is, 11.9 percent by weight of total solids, of polymethylene polyphenylisocyanate as in Example 167, was added and intimately mixed with the above composition by means of a high speed stirrer. The viscosity of this mixture at 60° C. was about 4,000 centipoise.

The aqueous phase, emulsification process, washing, washing, organic fluorochemical compound flow improver addition, and spray drying were as in Example 167.

Image deposits produced with this toner on plain paper were fixed at a pressure of 100 pounds per lineal inch when tested as in Example 167.

EXAMPLE 171

A two component pressure-fixable black toner composition was prepared as follows:

| | |
|---|---|
| Paraffin wax, melting range 57–60° C. | 25 grams |
| Safflower oil | 20 grams |
| Spindle oil, plasticizer | 15 grams |
| Carbon black pigment | 15 grams |
| Aniline black pigment | 25 grams |

The paraffin wax pressure-fixable material, the safflower oil matrix-forming co-reactant, and the spindle oil were heated to 70° C. and blended. The carbon black and aniline black pigments were added and the mixture transferred to a heated Cowles dissolver and milled for 3 hours at a temperature of 90°–120° C. The composition was then allowed to cool to 70° C.

The reactive isocyanate of Example 167 (33 grams) was added and intimately mixed with the above composition by means of a high speed stirrer. The viscosity of this mixture was about 5,000 centipoise at 60° C.

The composition was emulsified, washed, the organic fluorochemical compound added, and the dispersion dried as in Example 167 to produce toner particles of particle size generally within the range 10–15 microns, which were subsequently mixed with carrier material to form a two component developer, which was applied by means of cascading onto the selenium photoconductor in a conventional plain paper copier. As evidenced by the sharpness and high density of the developed images formed by positive electrostatic charges on the selenium photoconductor, the toner was of negative polarity or negatively tribocharging. The toner deposits formed on the photoconductor were electrostatically transferred onto plain paper and fixed thereon by passing the paper sheet between a pair of pressure rollers. Because of matrix-induced particle disintegration upon application of pressure and the presence of the spindle oil plasticizer in the toner composition, image deposits produced with this toner were fixed at an applied pressure of 100 pounds per lineal inch.

Repeated copier testing showed the flow properties of the toner to be satisfactory, and no deterioration in flow properties was noted with repeated use of the toner, indicating firm attachment of the flow improver to the toner particles.

EXAMPLE 172

Example 171 was repeated with the exception that the carbon black and aniline black pigments were replaced with 40 grams of phthalocyanine blue pigment. This resulted in a two component pressure-fixable cyan toner.

EXAMPLE 173

Example 171 was repeated with the exception that the carbon black and aniline black pigments were replaced with 40 grams of barium lithol red pigment. This resulted in a two component pressure-fixable magenta toner.

EXAMPLE 174

A non-magnetic single component pressure-fixable black toner composition was prepared as follows:

| | |
|---|---|
| Paraffin wax, melting range 57-60° C. | 30 grams |
| Safflower oil | 20 grams |
| Spindle oil, plasticizer | 10 grams |
| Carbon black pigment | 15 grams |
| Aniline black pigment | 25 grams |

The paraffin wax pressure-fixable material, the safflower oil matrix-forming co-reactant, and the spindle oil were heated to 70° C. and blended. The carbon black and aniline black pigments were added and the mixture transferred to a heated Cowles dissolver and milled for 3 hours at a temperature of 90°-120° C. The composition was allowed to cool to 70° C.

The reactive isocyanate of Example 167 (33 grams) was added and intimately mixed with the above composition by means of a high speed stirrer. The viscosity of this mixture was about 5,500 centipoise at 60° C.

The composition was emulsified, washed, the organic fluorochemical compound added, and the dispersion dried as in Example 167 to produce toner particles of particle size generally within the range of 10-25 microns.

The toner was applied to a selenium photoconductor in a plain paper copier using a toning unit of the general type as in U.S. Pat. No. 4,232,628 of Shelffo. As evidenced by the sharpness and high density of the developed images formed by positive electrostatic charges on the selenium photoconductor, the toner was of negative polarity or negatively tribocharging. The toner deposits formed on the photoconductor were electrostatically transferred onto plain paper and fixed thereon by passing the paper sheet between a pair of pressure rollers. Because of matrix-induced particle disintegration upon application of pressure and the presence of the spindle oil plasticizer in the toner composition, image deposits produced with this toner were fixed at an applied pressure of 100 pounds per lineal inch. The flow properties of the toner were satisfactory and no change in flow was noted during repeated copier operation.

EXAMPLE 175

Example 174 was repeated, with the exception that the carbon black and aniline black pigments were replaced with 40 grams of phthalocyanine blue pigment. This resulted in a non-magnetic single component pressure-fixable cyan toner.

EXAMPLE 176

Example 174 was repeated, with the exception that the carbon black and aniline black pigments were replaced with 40 grams of barium lithol red pigment. This resulted in a non-magnetic single component pressure-fixable magenta toner.

EXAMPLES 177-186

Each of Examples 167-176 were repeated with the exception that the "Fluorad" FC-430 ester was replaced with an equal weight of a fluorinated alkyl polyoxyethylene ethanol ("Fluorad" FC-170C). In this instance adherence of the solubilising end of the "Fluorad" FC-170C molecules to the spheres appeared to be primarily by adsorption.

EXAMPLES 187-196

Each of Examples 167-176 was repeated with the exception that the "Fluorad" FC-430 ester was replaced with an equivalent solids weight of fluorinated alkyl quaternary ammonium iodides ("Fluorad" FC-135 made by Minnesota Mining and Manufacturing Company, supplied as a 50 percent by weight solution in an isopropanol/water mixture). In this instance adherence of the solubilising end of the "Fluorad" FC-135 molecules to the spheres also appeared to be primarily by adsorption.

The toners of Examples 177-196 were tested in the same manner as in Examples 167-176 and copier performance was generally equivalent to that shown in the analagous Examples 167-176. As in the previous Examples, no deterioration in flow properties of the various toners was noted with repeated use in the appropriate copier, indicating that the flow improver was firmly attached to the toner particles.

In each of the Examples 136-196 the organic fluorochemical compound was added in a proportion of about 0.2 percent based on the dry weight of the toner. Generally, it appears that the quantity of organic fluorochemical compound can be varied within the range 0.01 percent to 1 percent by weight, preferably 0.05 percent to 0.5 percent by weight to obtain the advantageous effects of improved flow characteristics.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. Method of preparing spherical toner particles comprising:

(1) admixing a colorant, a pressure-fixable material, an isocyanate, and a matrix-forming co-reactant to form a mixture, (2) emulsifying said mixture in an aqueous medium containing a non-reactive emulsifying agent to provide a dispersion of spheres of said mixture, (3) hydrolyzing a first portion of the isocyanate near the surface of said spheres by contact with water in the aqueous medium to initiate formation of polyurea (a) at the surface of said spheres as a thin, substantially continuous layer and (b) in the interiors of said spheres as a continuum for some distance beneath the surfaces of said spheres, said continuum being a polyurea matrix, and reacting a second portion of the isocyanate within said spheres with said matrix-forming co-reactant to form additional matrix material in the interiors of said spheres, (4) removing said emulsifying agent from the dispersion, and (5) removing the water from the dispersion to obtain dry, spherical toner particles.

2. The method of claim 1 wherein a charge control agent is introduced into the dispersion prior to the completion of the hydrolysis of the isocyanate.

3. The method of claim 2 wherein said charge control agent is an organic fluorochemical compound.

4. The method of claim 1 wherein a charge control agent is introduced into the dispersion after the emulsifying agent has been removed therefrom.

5. The method of claim 4 wherein said charge control agent is an organic fluorochemical compound.

6. The method of claim 1 wherein said emulsifying agent is removed from the dispersion by washing.

7. The method of claim 1 wherein the mixture in step 1 comprises from about 5% by weight to about 20% by weight matrix-forming co-reactant based on the combined weight of colorant, pressure-fixable material, and matrix-forming co-reactant.

8. The method of claim 1 wherein said matrix-forming co-reactant is selected from the group consisting of vegetable oils and synthetic drying oils.

9. The method of claim 1 wherein said isocyanate is selected from the group consisting of aromatic polyfunctional isocyanates and aliphatic polyfunctional isocyanates.

10. A spherical toner particle comprising a thin, substantially continuous surface layer of polyurea, surrounding an interior portion comprising a matrix comprising polyurea, said matrix having a colorant and pressure-fixable material contained therein, thereby providing discontinuities in said matrix, wherein said polyurea matrix forms a continuum extending inwardly from said continuous polyurea surface layer into the interior of said particle.

11. The toner particle of claim 10 wherein the colorant is selected from the group consisting of dyes and pigments.

12. The toner particle of claim 10 wherein said pressure-fixable material is selected from the group consisting of resins, polymers, and waxes having a melting point from about 50° C. to about 100° C.

13. The toner particle of claim 10 wherein said matrix further comprises a second urea-containing polymer.

14. The toner particle of claim 13 wherein said second urea-containing polymer is an acylurea polymer.

15. The toner particle of claim 10 wherein said particle further comprises a charge control agent adsorbed thereon.

16. The toner particle of claim 15 wherein said charge control agent is an organic fluorochemical compound.

17. The toner particle of claim 10 wherein said particle further comprises a charge control agent bonded thereto.

18. The toner particle of claim 17 wherein said charge control agent is an organic fluorochemical compound.

19. The toner particle of claim 10 wherein the diameter thereof can be from about 1 to about 40 micrometers.

* * * * *